US006264551B1

(12) United States Patent
Smith

(10) Patent No.: US 6,264,551 B1
(45) Date of Patent: Jul. 24, 2001

(54) CONCENTRIC AIR DIFFUSER

(76) Inventor: Randall L. Smith, 1519 Rowe wood Dr., Chattanooga, TN (US) 37421

( * ) Notice: Subject to any disclaimer, the term of this patent is extended or adjusted under 35 U.S.C. 154(b) by 0 days.

(21) Appl. No.: 09/658,700

(22) Filed: Sep. 8, 2000

(51) Int. Cl.[7] ..... F24F 7/00
(52) U.S. Cl. ..... 454/248; 454/245
(58) Field of Search ..... 454/245, 246, 454/247, 248

(56) References Cited

U.S. PATENT DOCUMENTS 3,326,112 * 6/1967 Sadlow et al. ..... 454/248
3,693,530 * 9/1972 Larkfeldt et al. ..... 454/248
3,885,462 * 5/1975 Krook ..... 454/248

OTHER PUBLICATIONS

Titus Product Catalogue 2000, p. F186.

* cited by examiner

*Primary Examiner*—Jiping Lu
(74) *Attorney, Agent, or Firm*—Stephen J. Stark; Miller & Martin LLP

(57) ABSTRACT

A concentric air diffuser for use with climate control systems to direct air to desired locations within the interior of a building and return air to the system includes a perforated plate between a supply inlet and supply vents. The perforated plate assists in balancing air flow out of the vents. Additionally, a baffle plate is located along the portion of the perforated plate below the supply inlet to assist in distributing air throughout the diffuser housing prior to allowing the air to flow through the clear area portion of the perforated plate and out through the vents.

20 Claims, 14 Drawing Sheets

PRIOR ART

PRIOR ART

PRIOR ART

CONCENTRIC AIR DIFFUSER

BACKGROUND OF THE INVENTION

1. Field of the Invention

The present invention relates, in general, to the area of heating, ventilating and air-conditioning systems including the elevated components through which air is supplied to a space to be ventilated and also returned to the system. More specifically, this invention relates to ceiling-mounted concentric air diffuser plenums for use with a climate control system.

2. Description of Related Art

Climate control systems such as heating, ventilation and air-conditioning systems (HVAC systems) are often utilized in buildings to provide a comfortable climate within the building. Some buildings utilize ducts within the building to direct air from a climate control unit to specific locations for further distribution throughout a desired space. Other buildings may utilize multiple climate control units in a system in an effort to minimize the length and quantity of ducts within the building. In some buildings, especially buildings of a commercial nature, the climate control system, often comprising a number of climate control units, is mounted on the roof. Preferably the roof is a flat roof immediately above a living or working space, although the air diffuser plenum of the preferred embodiments could be utilized in conjunction with pitched roofs and/or ductwork.

Concentric diffusers are useful to provide a single diffuser housing to supply ventilation to a space while also allowing for return air to be returned to the HVAC system. Typically supply air is provided through at least one inlet into the diffuser from the HVAC outlet to the diffuser vents, or outlets, while return air is returned through at least one return outlet of the diffuser to the HVAC system. Concentric air diffusers are often mounted in drop ceilings to minimize the number of locations for vents in ceilings since one diffuser may be used for both supply and return air.

One problem with typical concentric diffusers is the imprecise flow of air from different portions of the diffuser. Specifically, in a drop box type diffuser where air is supplied to a space through four lateral sides of the diffuser, manufacturers often advertise a particular cubic feet per minute of air distribution from the diffuser. For instance, for a 5-ton HVAC unit with 18 inch supply ducting and side vents twice the length of the end vents, the manufacturer may advertise a total of 2,000 cubic feet per minute supplied from the diffuser: 500 cfm from each end and 1,000 cfm from each side. In actuality, the diffuser may supply 875 cfm from a side and 825 cfm from an end at velocities at specific locations including 1750 feet per minute at a location along the end closest to the supply inlet of the diffuser while as little as 600 feet per minute at a portion of the opposite end. Thus, the supplied air is imbalanced.

Some manufacturers advertise that baffles may need to be installed after installation of the diffuser in order to balance air flow at that time. The problem with this method of balancing air flow is that with the diffuser installed with a ceiling, access may only be obtained at and through the vents since the top shroud often extends into the ceiling. In order to balance air flow some technicians may shut portions of the slats in the vents while opening other vent slats to a further degree. Unfortunately, when a vent slat is moved closer to the closed position, it may tend to vibrate and make more noise due to the relatively large amount of air attempting to rush through narrower openings in the vent. If the vents do not have moveable slats, then other methods may be necessary.

Accordingly, a need exists to provide balanced air flow out of a concentric diffuser without requiring measurements or adjustment of air flow after installation.

Another need exists to provide an internal baffle system which does not add additional noise to a diffuser.

Another need exists to provide a relatively inexpensive means for providing balanced air flow without requiring special measuring equipment or skills on the part of an operator.

It is therefore desirable to provide an improved concentric air diffuser.

Furthermore, a need exists for a more efficient air diffuser capable of more precisely directing air than has been known in the prior art.

It is therefore desirable, to have an improved air diffuser plenum.

BRIEF SUMMARY OF THE INVENTION

The present invention is a concentric air diffuser plenum for use with climate control systems to direct air to desired locations within the interior of a building from a supply while directing return air to the climate control system through a return. An inlet in the diffuser receives air from the climate control system. An outlet in the diffuser directs air back to the climate control system. A perforated plate is located within the diffuser separating the vents from the supply inlet. A baffle plate may also assist in diverting air across the perforated plate.

The perforated plate allows pressure to accumulate within the shroud to provide a more balanced air flow through the vents since much of the turbulence which is normally present within the concentric diffuser is drastically reduced through the use of the perforated plate and the air is more evenly distributed throughout the diffuser. An internal baffle located near the diffuser inlet assists in distributing the air within the diffuser shroud prior to delivery supply air through the vents.

Accordingly, it is an object of the present invention to provide a concentric air diffuser with an internal perforated plate which may be relatively inexpensive to manufacture and provides relatively, if not extremely accurately, balanced air flow.

BRIEF DESCRIPTION OF THE SEVERAL VIEWS OF THE DRAWING

The particular features and advantages of the invention as well as other objects will become apparent from the following description taken in connection with the accompanying drawings in which.

DETAILED DESCRIPTION OF THE INVENTION

FIGS. 1–6 and 15 are directed to drop box style concentric air diffusers. FIGS. 7–14 are directed to flush mounted concentric air diffusers. The principles of operation of both styles are similar in many respects.

Figure 1:
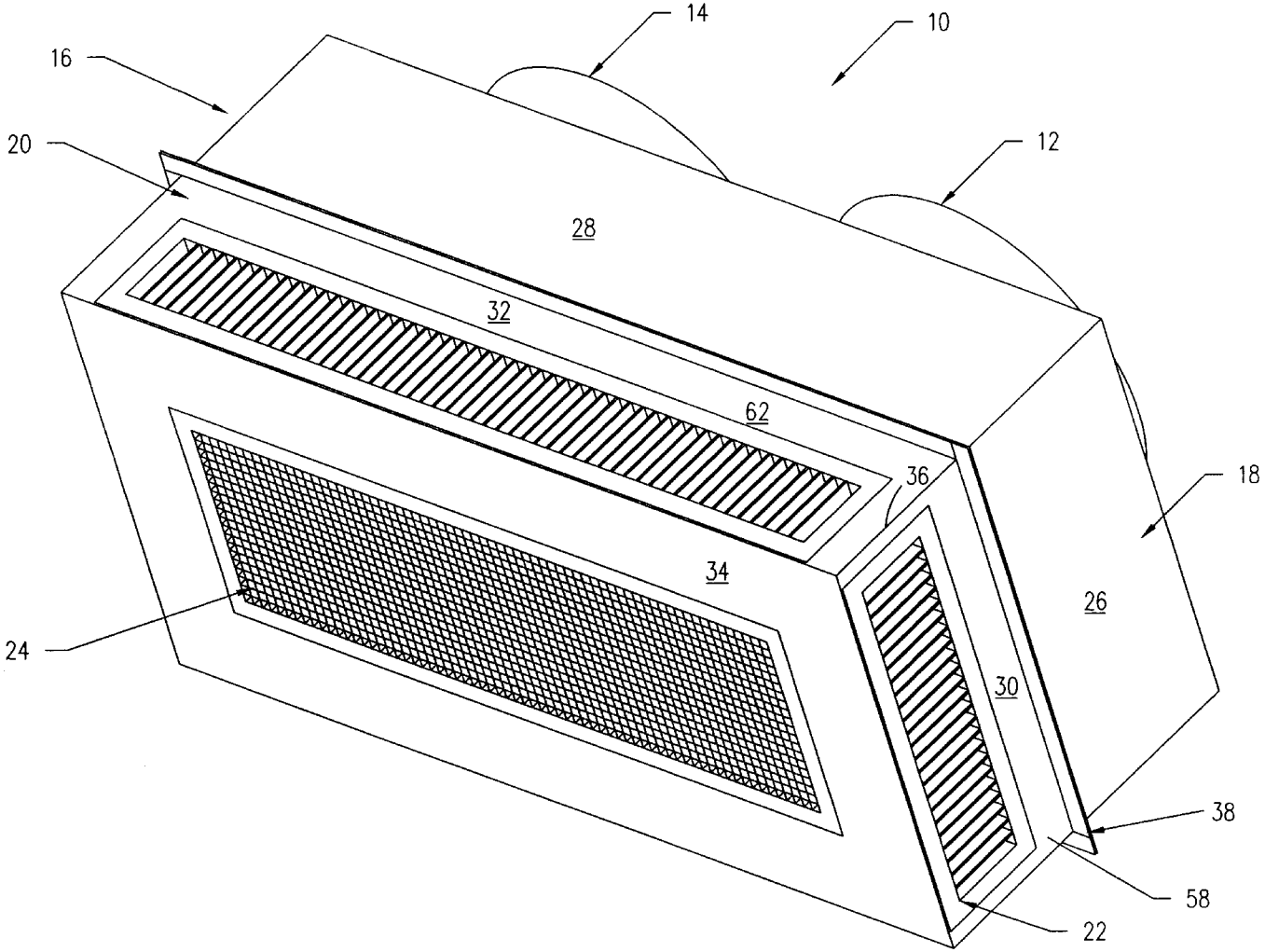
FIG. 1 is a bottom perspective view of a concentric air diffuser plenum of the drop box style.
Figure 7:
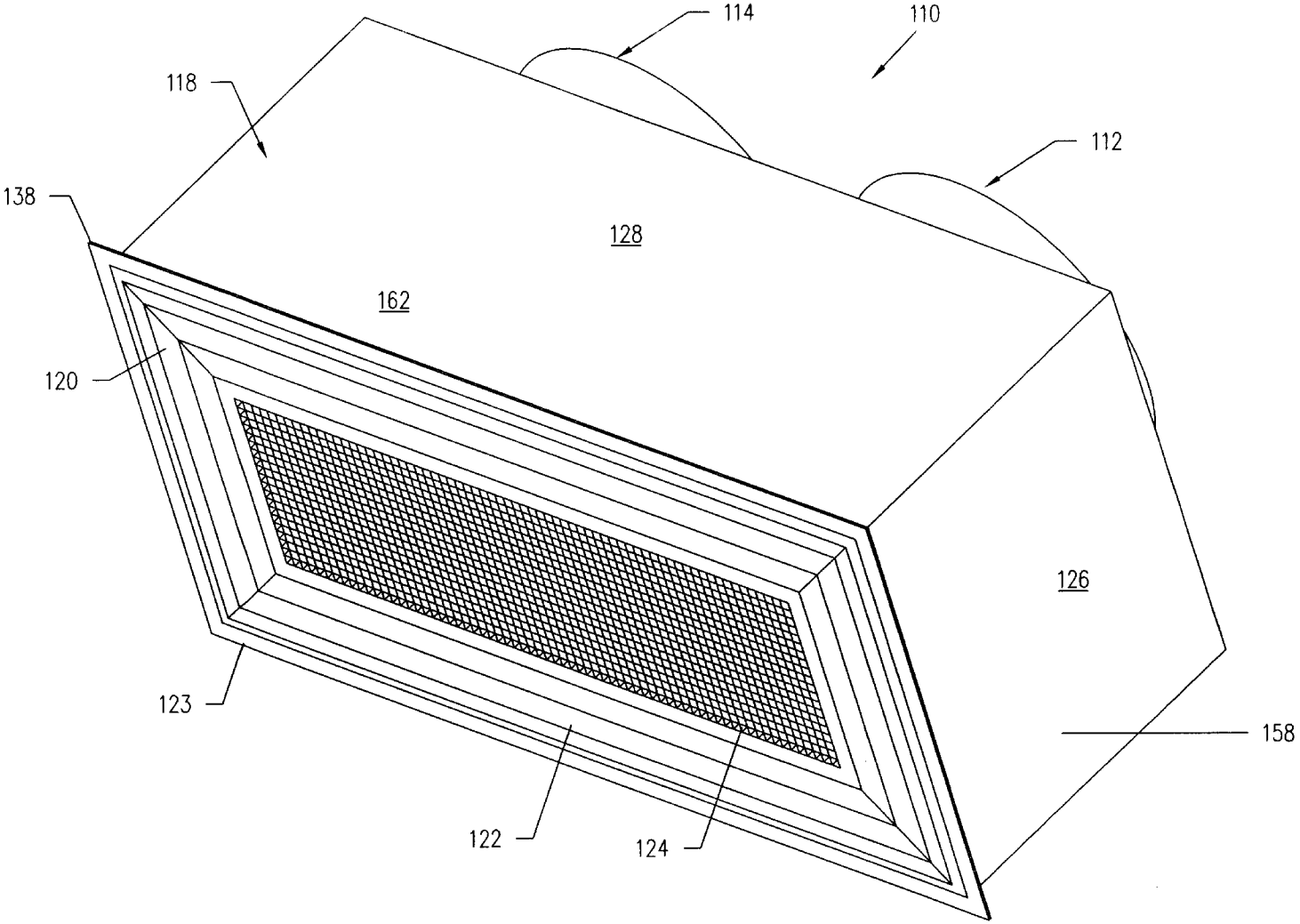
FIG. 7 is a bottom perspective view of a concentric air diffuser of the flush mounted style.

FIG. 1 is a typical concentric air diffuser 10 having a supply inlet 12 and a return outlet 14 which cooperates with the supply and return ducting from an HVAC system such as a roof mounted HVAC unit. The diffuser 10 has a housing 16 comprised of a shroud 18 atop a bottom portion 20. The embodiment shown in FIG. 1 has a drop box style bottom portion 20 illustrated while the embodiment in FIG. 7 illustrates a flush mount diffuser 110 having a flush mounted lower housing 120. In concentric air diffusers 10, 110 the supply air portion of the diffusers 10, 110 is separated from, or not in communication with, the return air portion.

Figure 13:
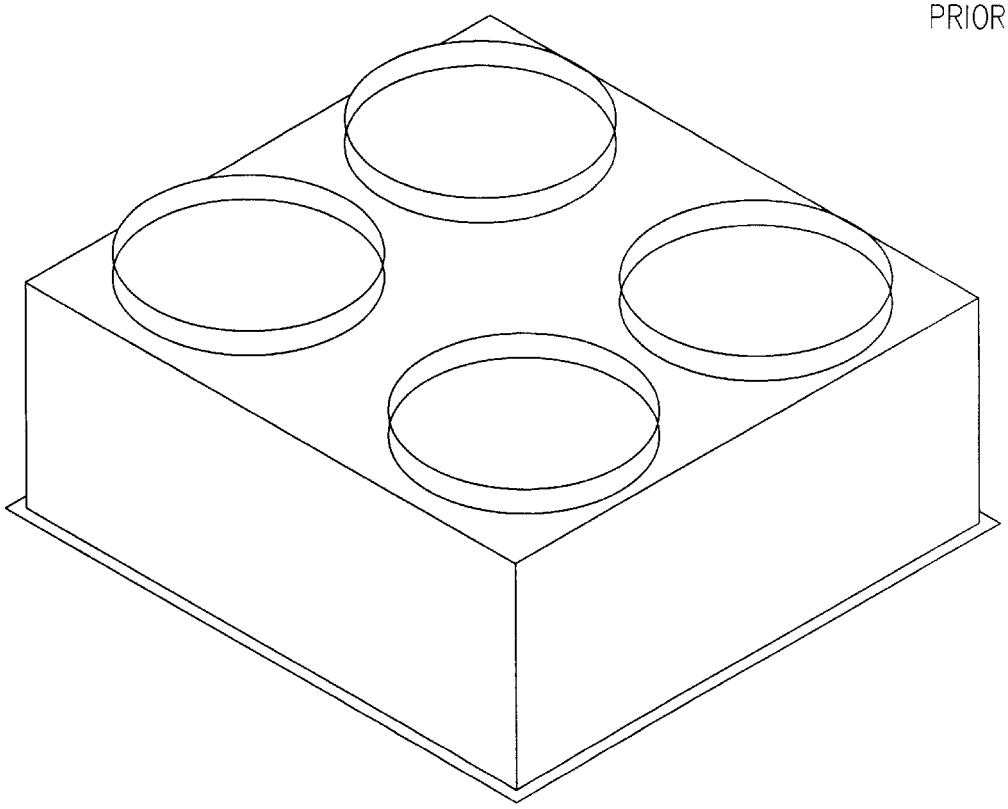
Fig-13 PRIOR ART
FIG. 13 is a top perspective view of a prior art concentric air diffuser of the flush mounted style with two supply inlets and two return outlets.
Figure 14:
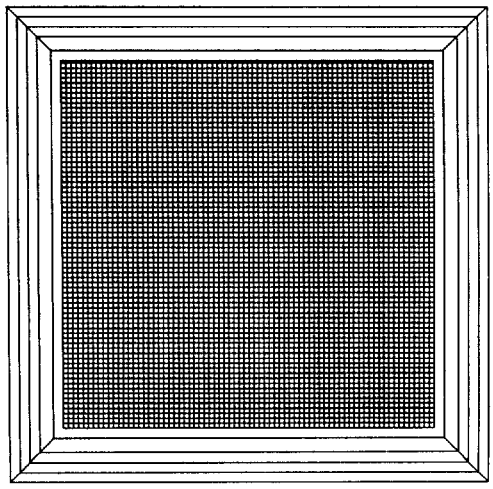
FIG. 14 is a bottom plan view of the prior art concentric air diffuser of FIG. 13.
Figure 15:
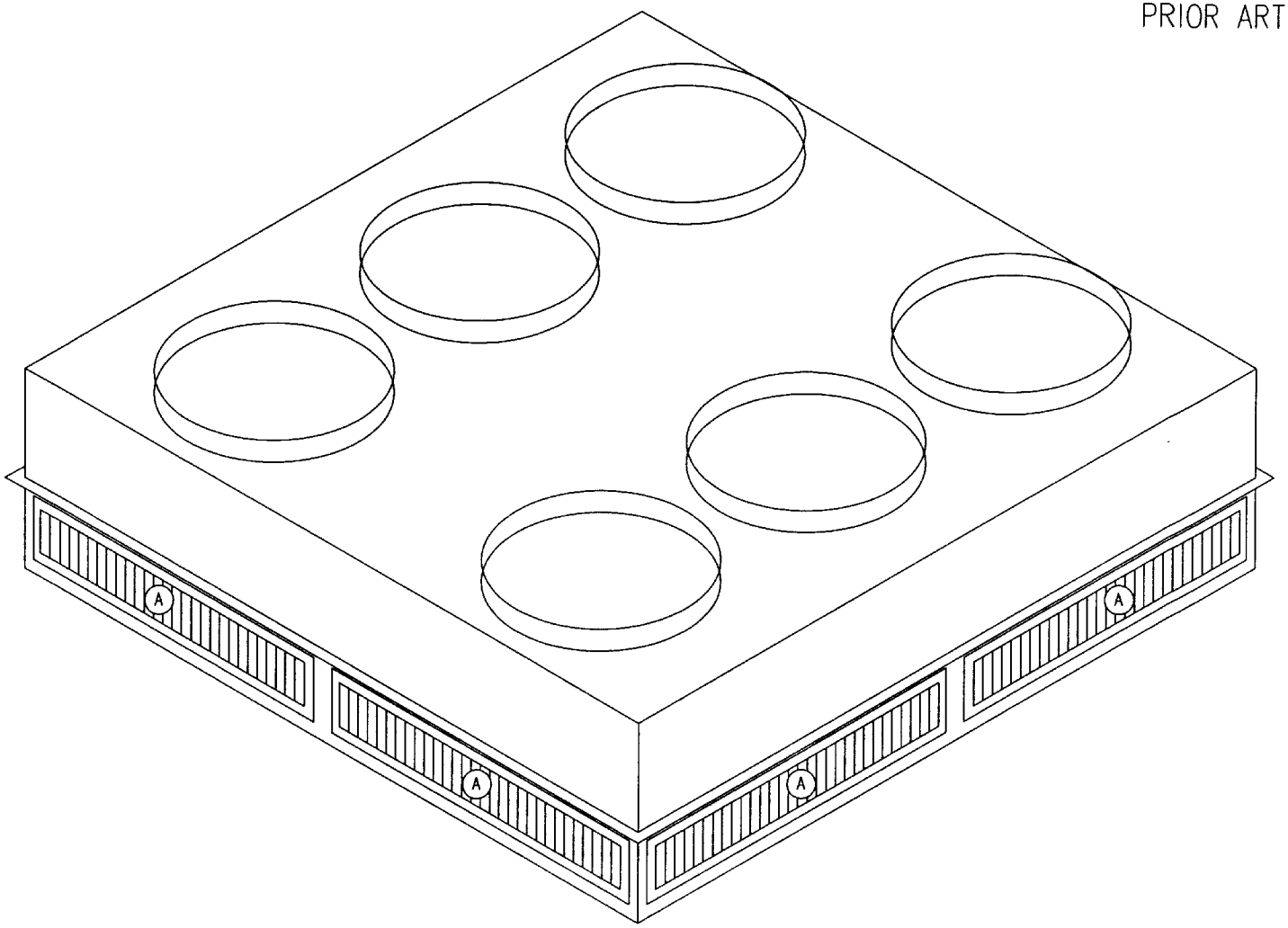
FIG. 15 is a top perspective view of a prior art concentric air diffuser of the drop box style.

Referring back to FIG. 1, the bottom portion 20 has vents 22 for supplying air to a space and a return air inlet 24 for returning air to the return outlet 14 for receiving air from a space. The shroud 18 has opposing ends 26 and opposing sides 28. The bottom portion 20 has opposing ends 30 and opposing sides 32. This style diffuser is often adapted to be installed in a drop ceiling. Most drop ceilings utilize 2 ft.×2 ft. or 2 ft.×4 ft. ceiling tiles. Accordingly, the illustrated diffuser 10 may be installed in a 2 ft.×4 ft. ceiling opening. Of course, other sizes and shapes are also contemplated by this design. FIGS. 13–15 are other common concentric air diffusers having multiple air supply inlets and return outlets. These diffusers may also be adapted as described herein.

In the drop box configuration FIG. 1, the bottom portion 20 has a bottom surface 34 housing the return air inlet 24. Comers 36 join the drop box ends 30 and sides 32 and may assist air to be directed through the vents 22. Flange 38 may assist in locating the diffuser 10 relative to the ceiling to which it is normally installed.

Figure 2:
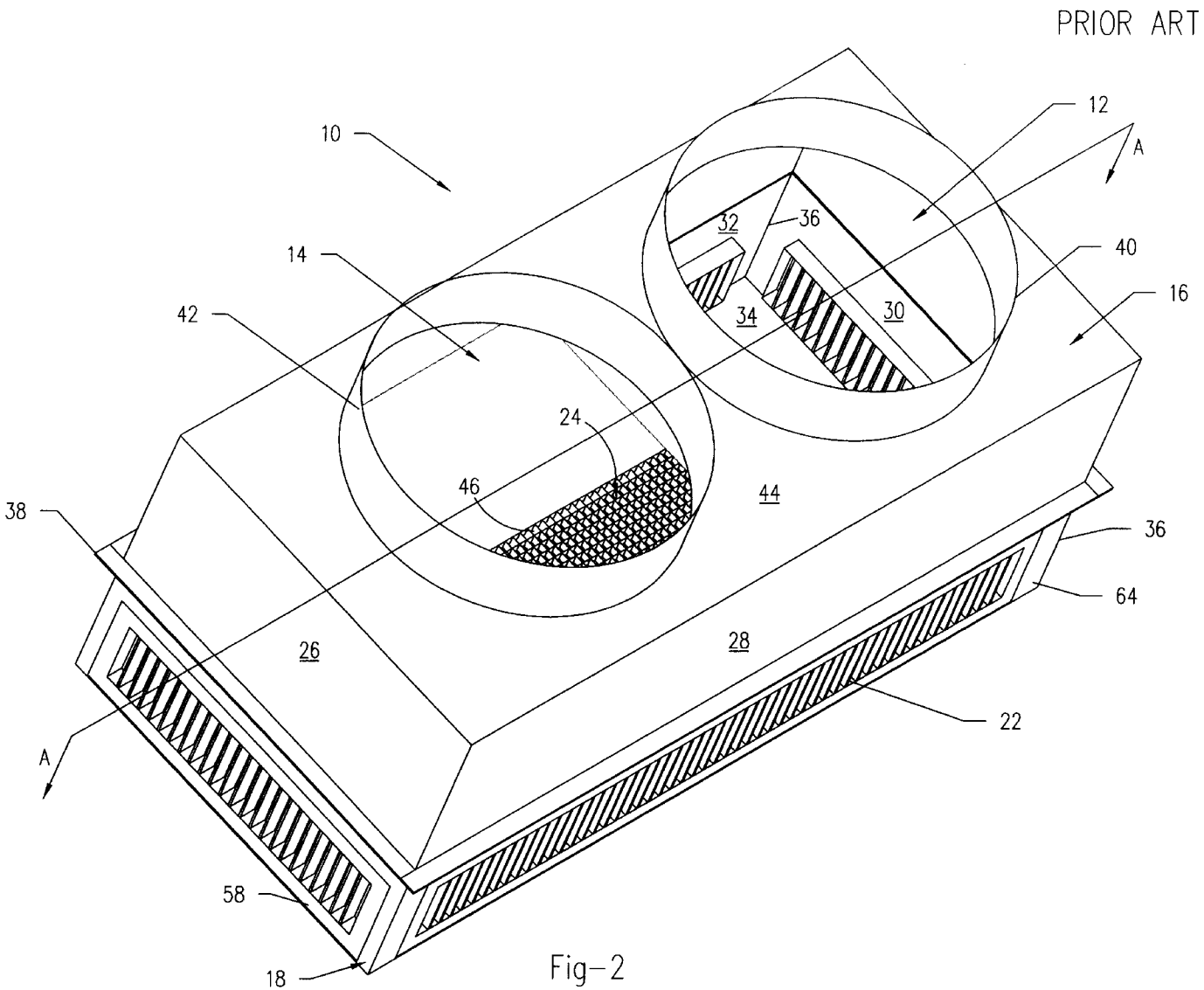
FIG. 2 is a top perspective view of a prior art concentric diffuser similar to the diffuser of FIG. 1.

FIG. 2 is a top perspective view of the diffuser 10 of FIG. 1. FIG. 2 also shows the top of the shroud 44 with supply connection 40 and return connection 42. Normally, the supply and return connections 40, 42 are cylindrical for cooperating with standard cylindrical ducting, however, other configurations could also be utilized.

Figure 3:
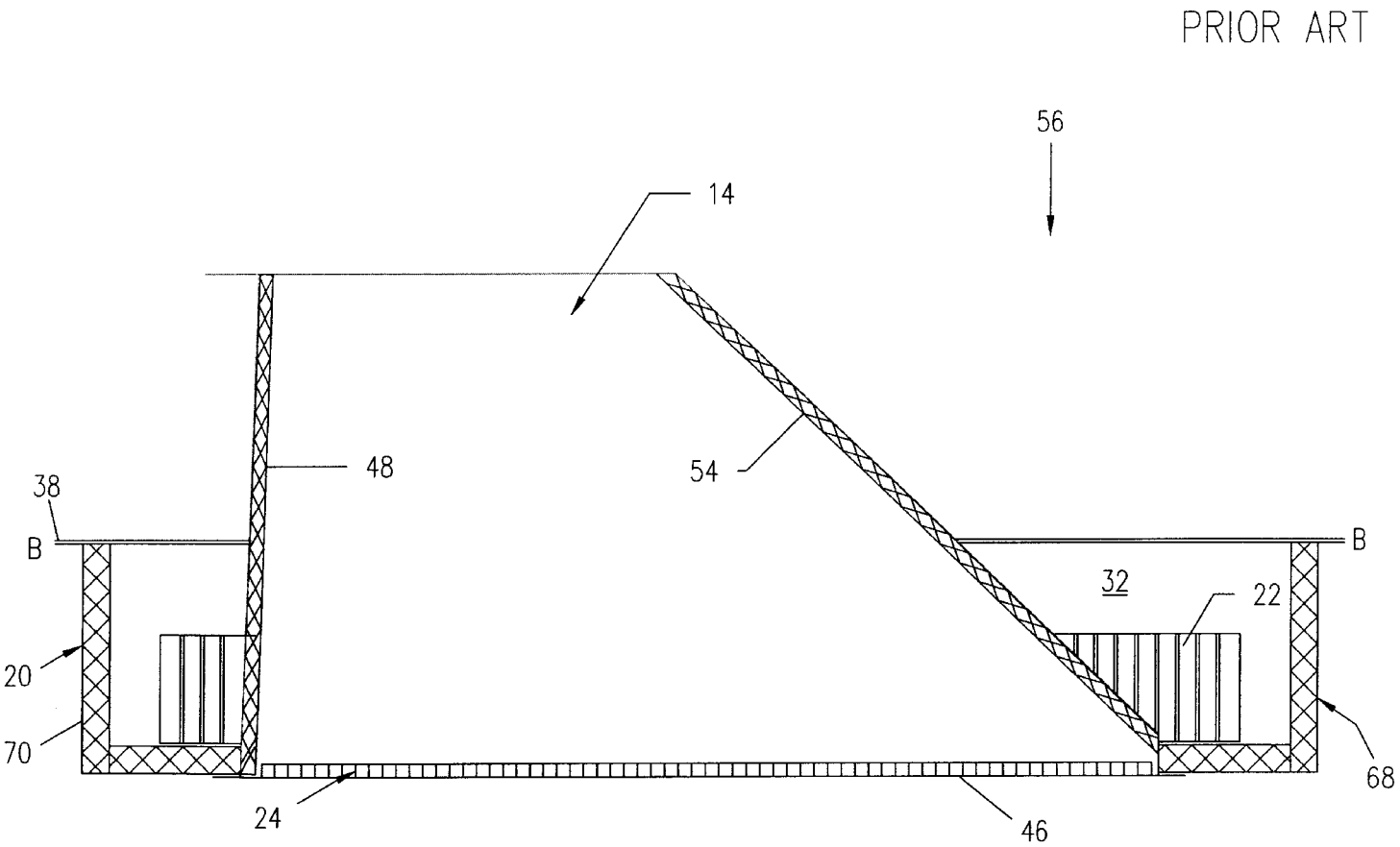
FIG. 3 is a cross-sectional view of the prior art diffuser of FIG. 2 taken along line A—A with the shroud removed.
Figure 4:
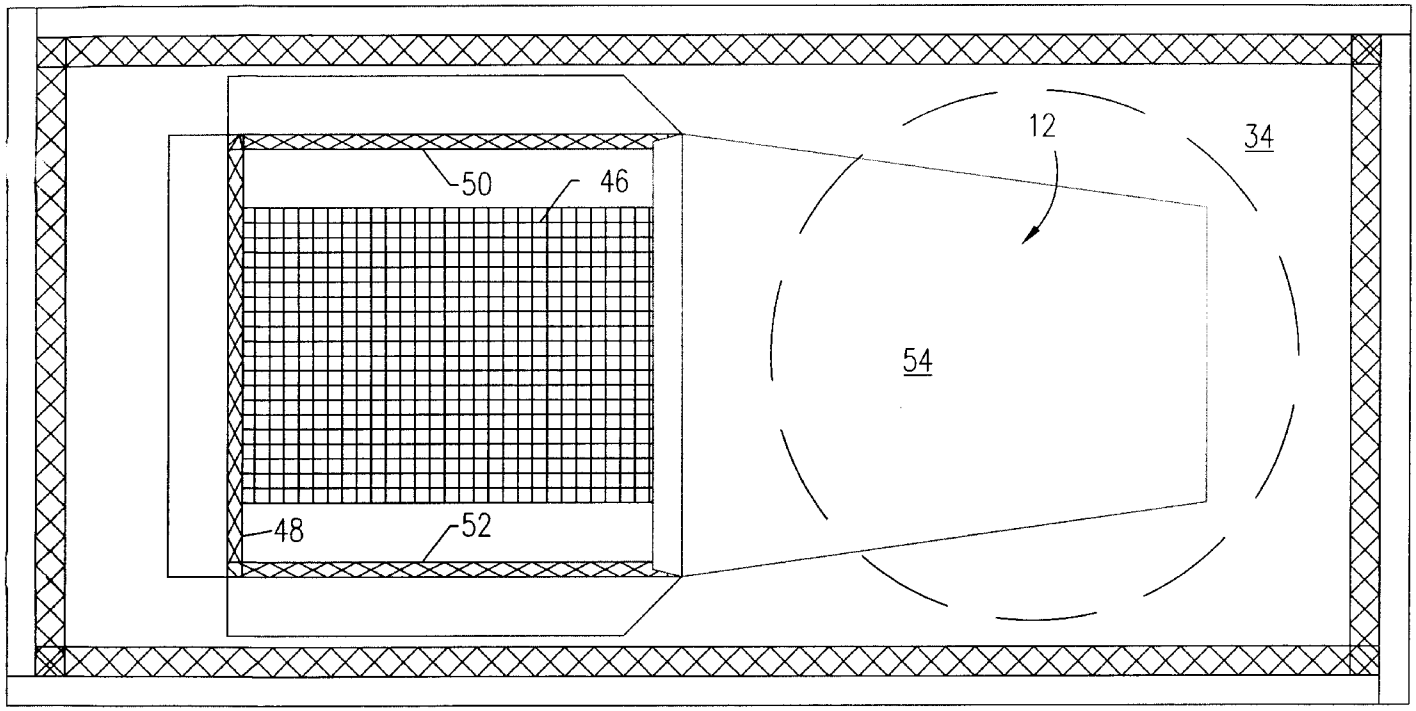
FIG. 4 is a top plan view of the prior art diffuser of FIG. 2 with the shroud removed.

FIG. 3 is a cross-sectional view of FIG. 2 taken along the line A—A with the shroud 18 removed. The bottom portion 20 is connected to the return air inlet 24. The return air inlet 24 is in communication with the return air outlet 14. The return cover 46 may cover at least a portion of return air inlet 24. Additionally, the return portion of the diffuser 10 may be separated from the supply portion by backwall 48 and angled wall 54. FIG. 4 also shows side walls 50, 52 which assist in separating the return portion of the diffuser 10 from the supply portion. Air enters through a supply inlet 12 at air entry 56 illustrated in FIG. 3. With the shroud 18 installed, air is directed along the angled wall 54 into the bottom portion 20. Air may escape through vents 22 in the bottom portion 20 to provide supply air to a space. The flange 38 is a convenient location to join the bottom portion 20 to the shroud 18 however other joining locations may be utilized.

FIG. 4 shows the side walls 50, 52. As can be seen in this figure, air enters through a supply air inlet 12 and is contained within the shroud 18 and bottom portion 20 until delivered to the vents 22 on the sides of the bottom portion 20. The angled wall 54 and the lower housing bottom 34 may assist in deflecting air out of the vents 22.

Unfortunately, air entering through the supply inlet 12 may be turbulent and may not leave the diffuser vents 22 balanced in terms of air flow. Furthermore, the design of the most concentric air diffusers 10 does not adequately assist to evenly distribute air out of the vents 22. Table A of the Appendix includes sample data from a five-ton air conditioning unit hooked to a standard concentric diffuser design. The manufacturer of this design advertises that baffles may need to be installed in order to balance air flow out of the vents 22 after installation. This would likely involve the adjusting of air flow out through the vents 22 which are at first end 68 and the first and second sides 62, 64 near the first end 68. This would assist in pushing air towards the second end 60 of the diffuser 10. Unfortunately, as some of the vents 22 are shut, the vents 22 may tend to vibrate or otherwise make noise thereby contributing to the noise of the diffuser 10. This would be undesirable.

Figure 5:
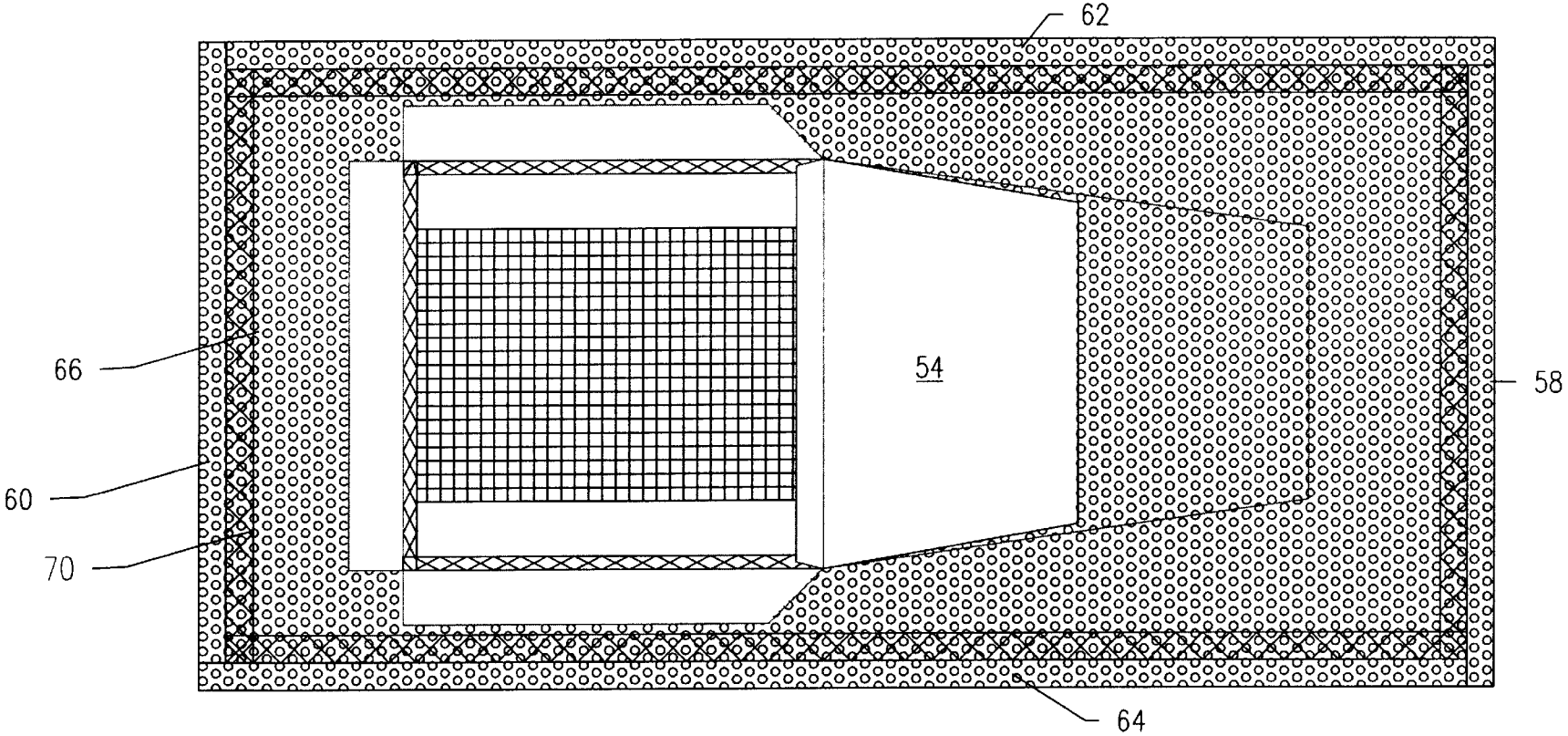
FIG. 5 is a diffuser similar to the diffuser of FIG. 4 with an installed perforated plate along the line B—B of FIG. 3, with the shroud removed according to the present invention.

FIG. 5 shows at least a portion of the improvement of the present invention. A perforated plate 66 is installed at line B—B of FIG. 3. This perforated plate 66 preferably contacts the return end wall 48, return side walls 50, 52 and return angled wall 54 along the plane B—B illustrated in FIG. 3. the perforated plate also preferably contacts the first end, second end, first side and second side 58–64 of the housing 12. The perforated plate may overlap the flange 38 to assist in constructing the diffuser 10 of the preferred embodiment. The perforated plate 66 illustrated restricts the flow of air through the perforated plate 66. As air enters through supply inlet 12 into the shroud 18, the perforated plate 66 assists in distributing the air about the shroud 18 above the plate 66. Although the pressure drop across the plate 66 is greater along plane B—B than would be without the plate 66, the greater pressure differential is believed to dampen turbulence and assist in providing a more balanced air flow out of the vents 22.

Although the illustrated perforated plate 66 has 51% free area, the perforated plate could have 60%, 68% or other amount of free area. One way to realize 51% free area is with a plate 66 having 3⁄16" holes 70 spaced at ¼" centers. The 68% free area perforated plate 66 would have ¼" holes spaced at ⅜" centers. It has been found desirable to include at least as much free area through the plate 66 as exists across the inlet 12 (i.e., for a round 18" inlet, about 254 in.$^2$ of free area through the perforated plate 66 would be desirable in many applications). Although the perforated plate as shown as having holes 70, other configurations including diamond shapes, squares, and others as known in the art. Additionally, the perforations may change along the length from the first end to the second end of the perforated plate 66 (i.e., 51% free area near the first end, but varying to 68% free area near the second end, etc.) The percent free area may also vary along the length (i.e., get progressively larger or smaller in value).

Figure 6:
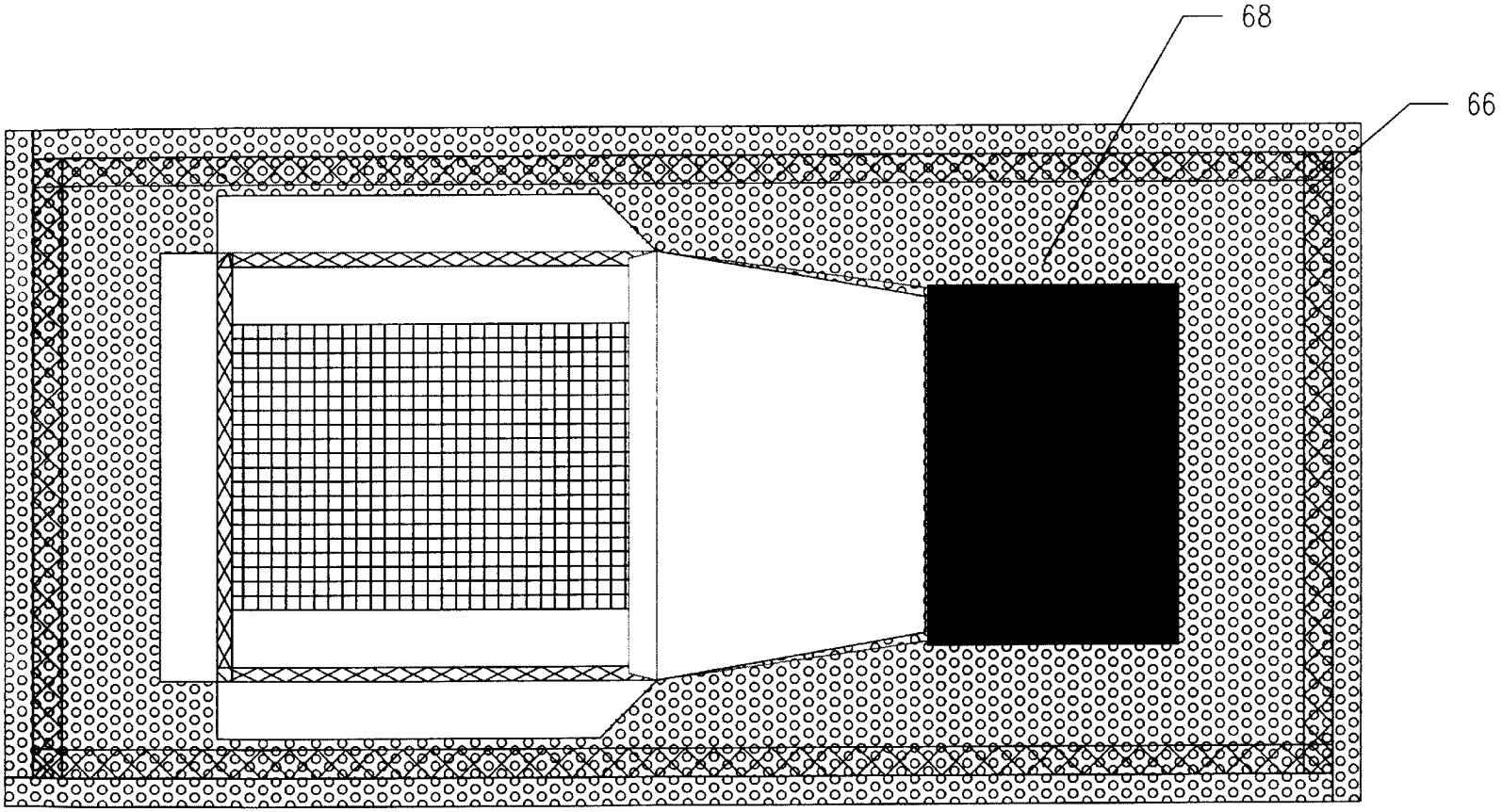
FIG. 6 is a top plan view of the diffuser of FIG. 5 including a baffle located substantially below the inlet supply for the diffuser in accordance with the preferred embodiment.

FIG. 6 includes baffle plate 68 which is illustrated below a portion of the supply inlet 12. The baffle plate 68 is located substantially along the plane B—B of FIG. 3. In the preferred embodiment, the baffle plate 68 is attached to the perforated plate 66 such as by screws or the like. The baffle plate 68 assists in directing the air supplied through the supply inlet 12 to other portions of within the shroud 18 before allowing supply air to proceed through the perforated plate 66 to the vents 22. The baffle plate 68 of the preferred embodiment is illustrated contacting the angled wall 54 substantially along the length of the angle wall 54. Furthermore, the baffle plate 68 may contain openings, curve portions, or other features which assist in balancing the air flow from the diffuser 10.

After installing the perforated plate 66 and baffle 68 in the diffuser 10 and attaching the test equipment used to prepare Table A, the air flows of Table B were achieved. It is believed that with precise selection of the shape and size of the baffle portion 68 and the percent free area along the length from the first end 58 to the second end 60 of the perforated plate 66, that a particular diffuser 10 may be made to be more balanced in terms of air flow. The baffle portion 68 utilized for this test was about 14 inches×12 inches and was positioned substantially as illustrated in FIG. 6 against the angled wall 54. Specifically, with the rudimentary experiment performed, the air flow from the first end changed from 65% too much air to about 5% too little air. Air out the first side 62 was altered from 87% to 110% of desired flow. Air out the second end 60 changed from 100% to 108% desired flow and air flow out the second side 64 changed from 107% to 105%.

Furthermore, the velocity of air out of specific locations along the lengths of the perforated plate and the width of the perforated plate was much more evenly distributed as illustrated in Table B. At the first end 58 velocities varied between 1475 feet per minute to 1750 feet per minute before the installation of the plate 66 and baffle 68. After the installation of the plate 66 and baffle 68 velocities varied between 1120 and 1200 feet per minute at any given location along the vent 22 of the first end 58. Along the first side 62, velocities varied from 1475 feet per minute to 500 feet per minute at certain locations. After the baffle plate 68 and plate 66 were installed, the velocities varied between -700 feet per minute and 1400 feet per minute, however, much more balanced air flow was exhibited along the length. Air from the second end 60 went from a range of 600 feet per minute to 1400 per minute before installation of the baffle 68 and perforated plate 66 to 1150 to 1370 feet per minute of the range. Accordingly, it may be observed that the installation of the perforated plate 66 and baffle 68 assisted in the distribution of more equivalent velocities out along the vents 22 from the ends 58, 60 and the sides 62, 64.

Figure 8:
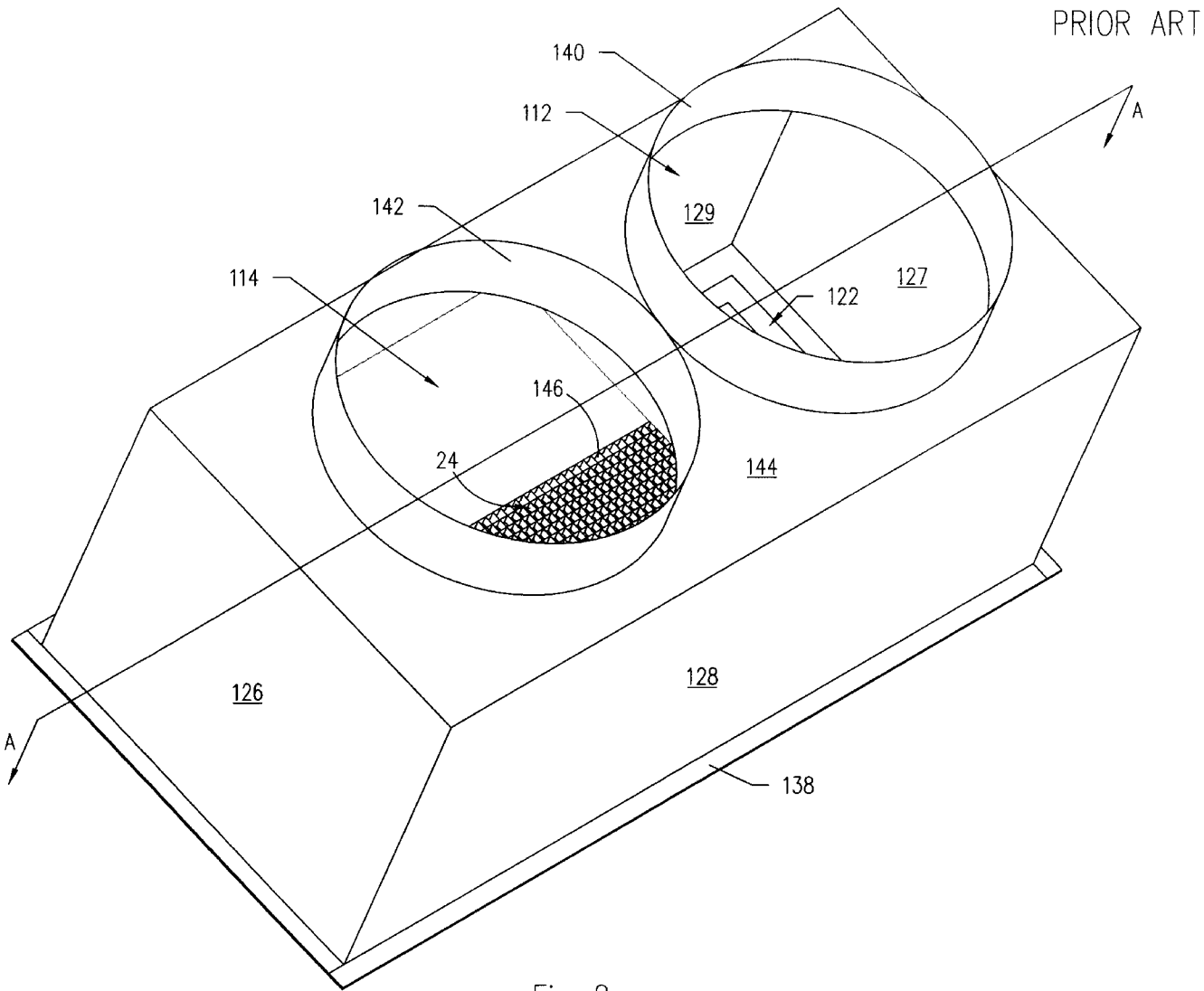
FIG. 8 is a top perspective view of a prior art concentric air diffuser similar to the diffuser of FIG. 7.

The second style of common concentric diffusers is the flush mounted variety illustrated in FIG. 7 through 14. FIG. 7 shows diffuser 110 with supply inlet 112 and return outlet 114. The diffuser housing 116 is comprised of a shroud 118 and a lower portion 120, vents 122 are located on a bottom surface 123 of the lower portion 120 around the return air inlet 124. The shroud has first and second ends 126, 127 and first and second sides 128, 129. The ends and sides correspond with the first and second ends 158, 160 and first and second sides 162, 164 in a similar fashion as explained above for the drop box style diffuser 10. The flange 138 of this style diffuser 110 is located proximate to the bottom portion 123 of the lower portion 120 such that the vents 122, flange 138 and return air inlet 124 are substantially the only portion of the diffuser 110 visible when the diffuser 110 is installed into a ceiling as described above. FIG. 8 shows the top of the shroud 144 with supply inlet 112 and return outlet 114. The supply connection 140 and 142 are also shown in this figure. The return grate 146 may cover the return air inlet 124.

Figure 9:
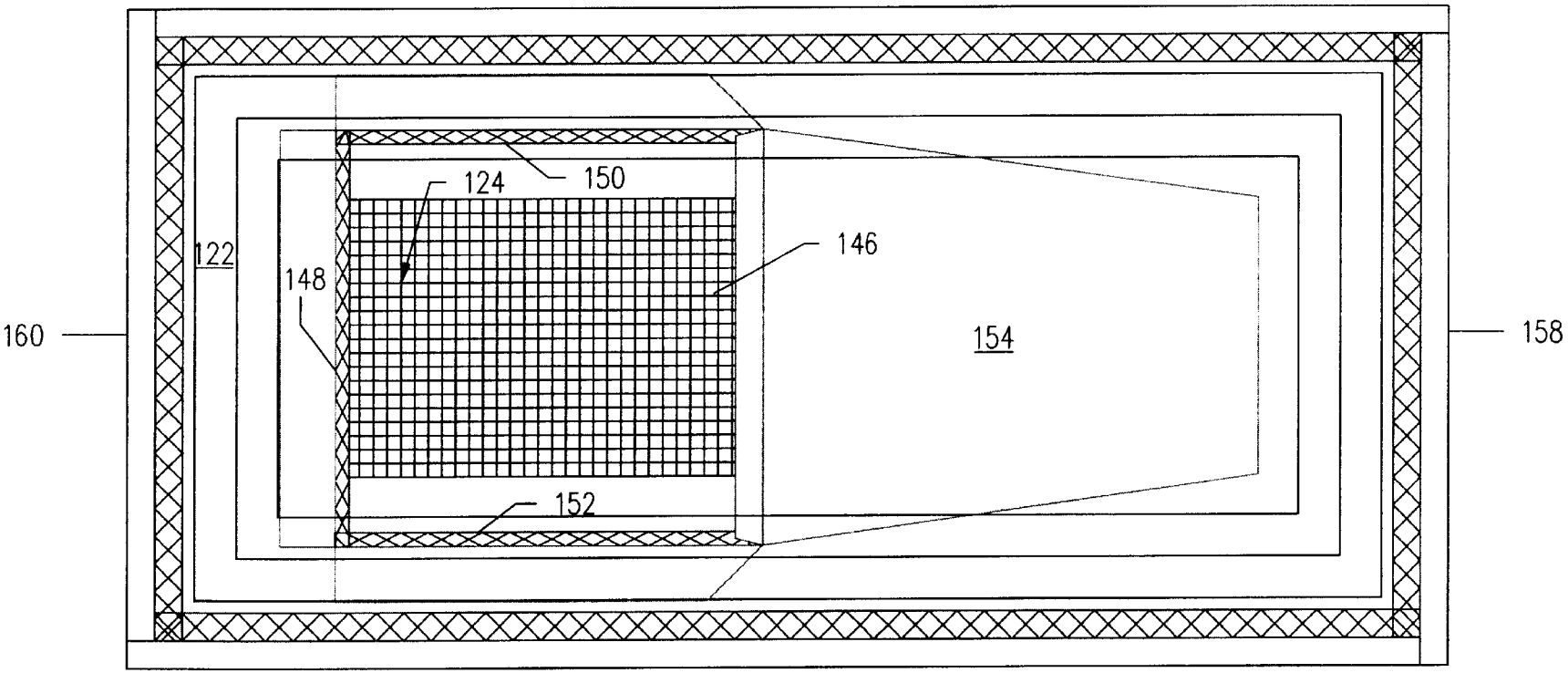
FIG. 9 is a top plan view of the prior art diffuser of FIG. 8 with the shroud removed.

FIG. 9 is a top plan view of the lower portion 120 of the housing 116 with the shroud 118 removed. With the supply inlet 112 located substantially above the angled wall 154, it is obvious that most diffusers of this type may provide imbalanced air with a majority of the air flowing out the first end 158 as opposed to the second end 160. Just like in a drop box style configuration, the diffuser 110 is separated into supply and return portions. The return portion is separated from the supply portion by a rear wall 148, two side walls 150, 152 and a front angled wall 154 within the diffuser housing 116.

Figure 10:
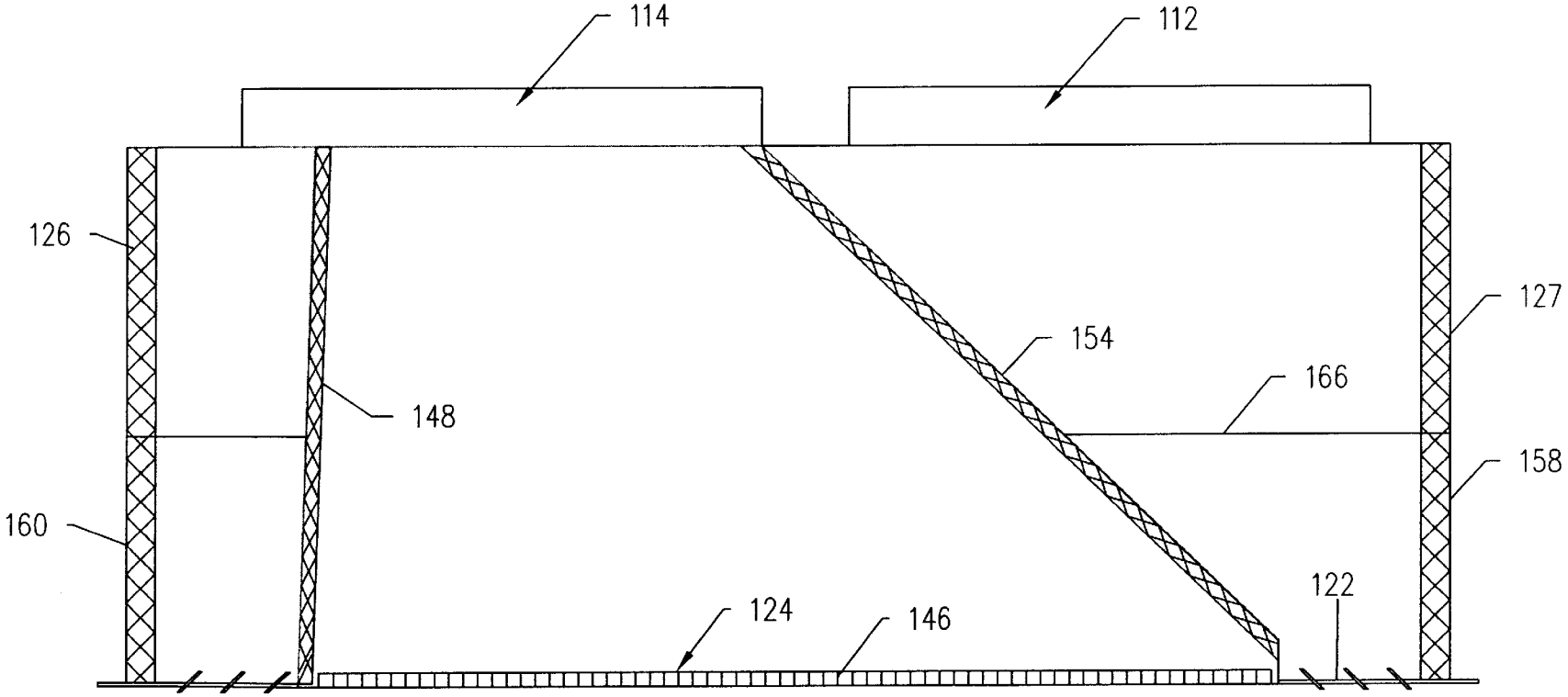
FIG. 10 is a cross-sectional view of a diffuser similar to the diffuser of FIG. 8 taken along the line A—A, with a perforated plate installed according to the present invention.

FIG. 10 illustrates a cross-sectional view of the alternatively preferred embodiment of the diffuser 110. This view is taken along the line A—A of a diffuser 110 similar to that of FIG. 8. As in the presently preferred embodiment 10, the alternatively preferred embodiment 110 includes perforated plate 166. The perforated plate 166 is spaced apart from the vents 122 to provide a space within the housing 116 for the supply air entering from supply inlet 112 to distribute along the top portion of the housing 116 prior to distribution through the perforated plate 166 prior to exiting the housing 116 through the vents 122. The spacing of the perforated plate 166 from the vents 122 may vary based on the HVAC system selected, the size of the supply inlet 112 and other factors. It is anticipated that the spacing will be at least 1 inch, 2 inches, 4 inches, or 6 inches or other spaced apart distance from the vents 122.

Figure 11:
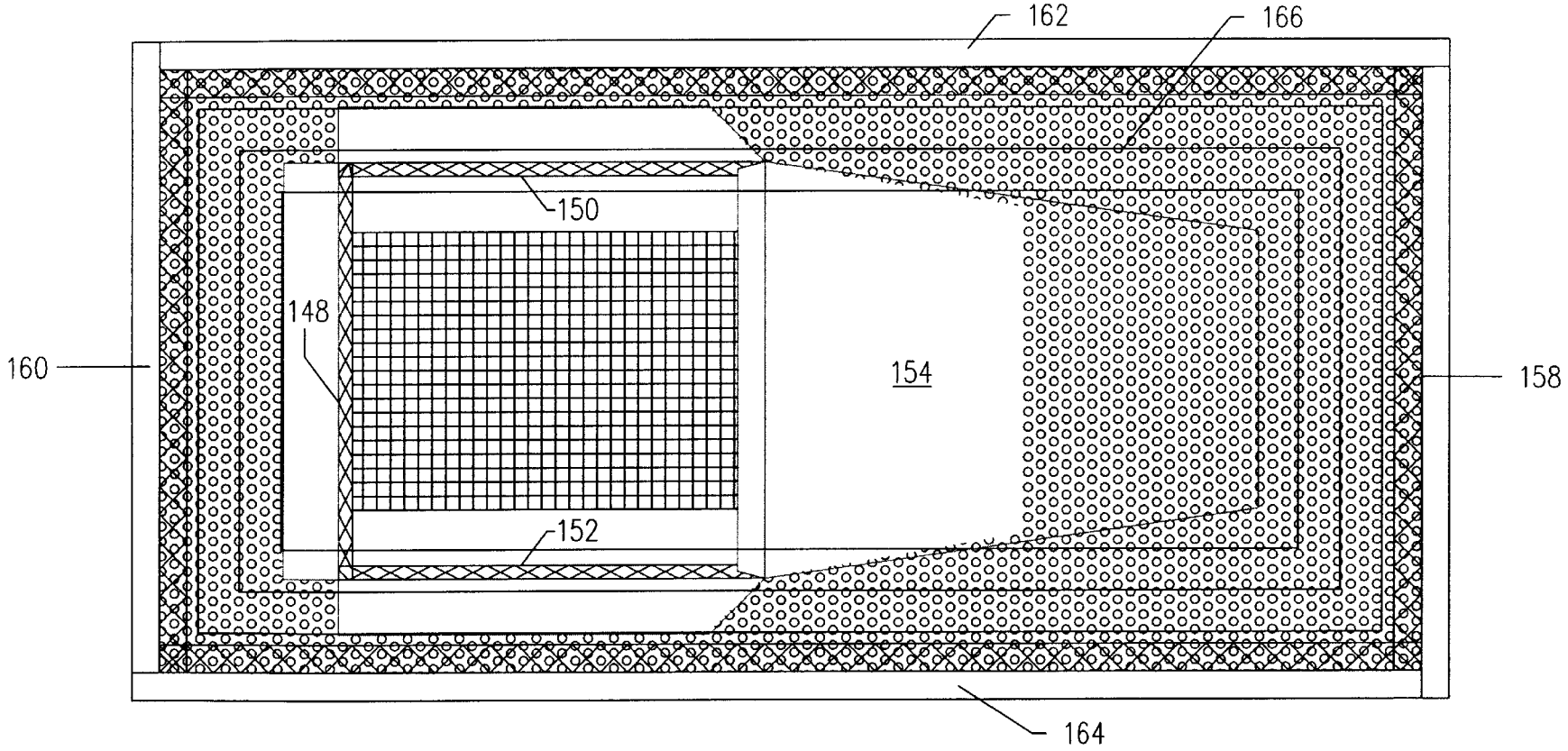
FIG. 11 is a top plan view of the diffuser of FIG. 10 with the shroud removed according to the present invention.
Figure 12:
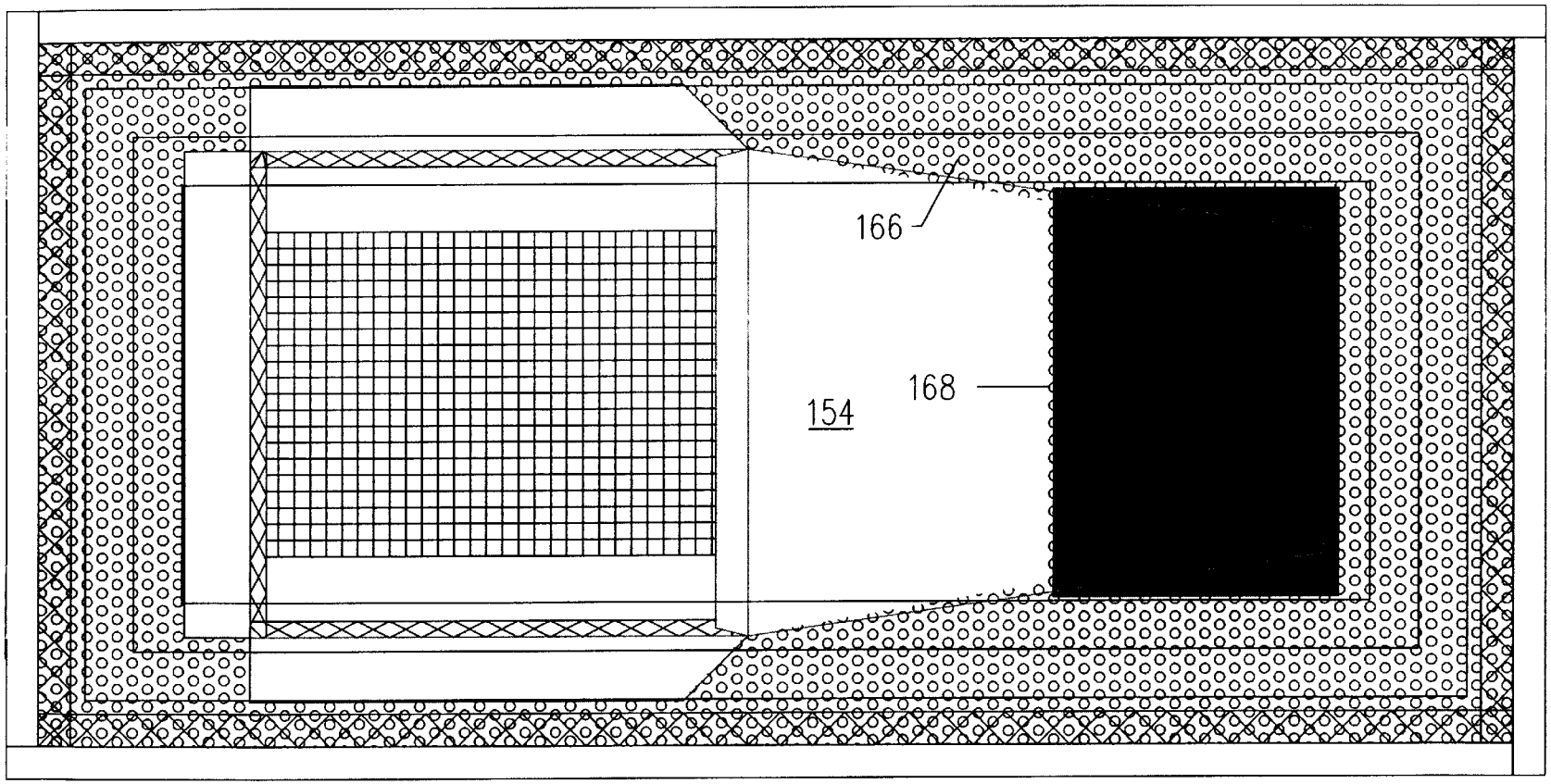
FIG. 12 is a top plan view of the diffuser of FIG. 11 including a baffle located substantially below the inlet supply for the diffuser in accordance with an alternating preferred embodiment.

FIG. 11 illustrates a view of the lower portion 120 of the housing 116 with the shroud 118 removed. The perforated plate 166 is illustrated above and spaced apart from the vents 122. Finally, FIG. 12 shows the insulation of baffle plate 168 relative to the angled wall 154 and perforated plate 166. The actual location and shape of the baffle 168 and the percent free area of the perforated plate 166 maybe different in the flush mounted style diffuser 110 than in the drop box style diffuser 10. Additionally, the percent free area may change along the length of the diffuser 110 from the first inlet 158 to the second 160 in a different manner than for the drop box style diffuser 110.

FIGS. 13–15 are directed to other prior art diffusers which may be equipped with the improvement described and illustrated herein. Supply air from multiple supply inlets, and possibly sources, may be balanced utilizing the baffle system as described above.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. An air diffuser for providing supply air to a space external to the diffuser, said diffuser comprising:

a housing having a supply portion and a return portion separated from one another within the housing, the supply portion having a supply inlet communicating with at least one supply vent, the return portion having a return outlet communicating with a return inlet; and a perforated plate located within the supply portion of the housing spaced apart from the at least one vent, wherein the supply air is directed through the air diffuser from the supply inlet and through the perforated plate prior to exiting through the at least one supply vent into the space.

2. The air diffuser recited in claim 1 wherein the perforated plate has 51% free area.

3. The air diffuser of claim 1 wherein the perforated plate has at least as much free area as an area across the supply inlet.

4. The air diffuser of claim 1 wherein the perforated plate has a substantially constant percentage of free area along the length of the perforated plate.

5. The air diffuser of claim 1 wherein the housing is further comprised of a shroud connected to a lower portion and the perforated plate adjoins a portion of the shroud.

6. The air diffuser of claim 5 wherein the supply and return ports are separated within the housing by a rear wall, two side walls and an angled front wall, and said perforated plate adjoins the rear wall, the side walls and the angled front wall.

7. The air diffuser of claim 5 wherein the lower portion includes a plurality of vents directing air from the sides of the lower housing, the return inlet is located in a bottom portion of the lower housing, and the perforated plate is located a distance above the at least one vent.

8. The air diffuser of claim 1 further comprising a baffle plate adjacent to the perforated plate.

9. The air diffuser of claim 8 wherein the baffle plate extends substantially parallel to the perforated plate.

10. The air diffuser of claim 8 wherein the supply portion and the return portions are at least partially separated by an angled front wall and the baffle plate contacts a portion of the angled front wall.

11. An improvement to a concentric air diffuser having a housing with a supply portion and a return portion at least partially separated within the housing by a rear wall, two side walls, and a front angled wall, said supply portion having a supply inlet located at a top portion of the housing, said supply inlet communicating with at least one vent within the housing and said return portion having a return inlet communicating with a return outlet within the housing, said return outlet located on a top portion of the housing, said improvement comprising:

a perforated plate located within the supply portion of the housing between the supply inlet and said at least one vent and spaced apart from said at least one vent; and a baffle plate parallel to and connected to the perforated plate, at least a portion of the baffle plate located directly below the supply inlet.

12. The improvement to the concentric air diffuser of claim 11 wherein the perforated plate has at least as much free area as a cross sectional area of the supply inlet.

13. The improvement to the concentric air diffuser of claim 11 wherein the housing is comprised of a shroud connected to a lower housing.

14. The improvement to the concentric air diffuser of claim 13 wherein the lower housing further comprises at least four lateral sides and a bottom, and at least one of said at least one vent is located on each of said four lateral sides.

15. The improvement to the concentric air diffuser of claim 11 wherein the lower housing further comprises a bottom, and the return inlet is located at the bottom of the lower portion.

16. An air diffuser for providing supply air to a space external to the diffuser, said diffuser comprising:

a housing having a supply portion and a return portion separated from one another within the housing by a plurality of walls;

the supply portion having a supply inlet connected to the housing and at least one vent connected to the housing and communicating with the supply inlet within the housing;

the return portion having a return inlet connected to the housing and a return outlet connected to the housing, the return outlet communicating with the return inlet within the housing;

the housing having a shroud connected to a lower portion, the lower portion having a bottom connected to the return inlet; and a perforated plate located within the supply portion of the housing spaced apart from said at least one vent, wherein the supply air is directed from the supply inlet through the perforated plate and out the at least one vent to the space.

17. The air diffuser of claim 16 wherein the bottom of the lower portion of the housing is substantially planar and the perforated plate is substantially parallel to the bottom of the lower portion of the housing.

18. The air diffuser of claim 17 further comprising a baffle plate connected to the perforated plate.

19. The air diffuser of claim 18 wherein the baffle plate is connected to the perforated plate and is substantially parallel to the perforated plate and the bottom of the lower portion of the housing.

20. The air diffuser of claim 18 wherein the baffle plate contacts at least one of the walls within the housing.

* * * * *